US006142224A

United States Patent [19]

Stuebinger et al.

[11] Patent Number: 6,142,224

[45] Date of Patent: Nov. 7, 2000

[54] TRIPLE ACTION PUMPING SYSTEM WITH PLUNGER VALVES

[75] Inventors: Lon A. Stuebinger, Littleton, Colo.; Howard L. McKinzie, Sugar Land; Brock W. Watson, Longview, both of Tex.

[73] Assignee: Texaco Inc., White Plains, N.Y.

[21] Appl. No.: 09/229,845

[22] Filed: Jan. 12, 1999

Related U.S. Application Data

[63] Continuation-in-part of application No. 09/108,505, Jul. 1, 1998.

[60] Provisional application No. 60/059,779, Sep. 23, 1997.

[51] Int. Cl.[7] ..... E21B 43/00

[52] U.S. Cl. ..... 166/105.5; 166/305.1; 166/369

[58] Field of Search ..... 166/105, 105.5, 166/106, 263, 305.1, 313, 369; 417/536, 535; 405/128

[56] References Cited

U.S. PATENT DOCUMENTS

| | | | |
|---|---|---|---|
| 2,049,391 | 7/1936 | Gee | 417/487 |
| 4,766,957 | 8/1988 | McIntyre | 166/265 |
| 4,960,369 | 10/1990 | Graves | 417/536 |
| 5,176,216 | 1/1993 | Slater et al. | 166/105.5 |
| 5,335,732 | 8/1994 | McIntyre | 166/313 |
| 5,425,416 | 6/1995 | Hammeke et al. | 166/105.5 |
| 5,497,832 | 3/1996 | Stuebinger et al. | 166/369 |
| 5,579,838 | 12/1996 | Michael | 166/106 |
| 5,697,448 | 12/1997 | Johnson | 166/369 |
| 5,816,326 | 10/1998 | Slater | 166/369 |

OTHER PUBLICATIONS

Miller, *The American Oil & Gas Reporter*, Jan., 1997, p. 76–80.

Miller, *The American Oil & Gas Reporter*, Mar., 1997, p. 106–109, 132.

Stuebinger et al., SPE Paper No. 38790, Society of Petroleum Engineers, 1997, pp. 1–10.

MBC Inc., *Introducing a Concurrent Process of Gas Production/Water Disposal*, 10 pages. (undated).

Reda, *Downhole Dewatering Systems*, 6 pages, 1997.

Chriscor, a division of IPEC Ltd., *Chriscor Downhole Water Injection Tool*, 6 pages. (undated).

*Primary Examiner*—David Bagnell
*Assistant Examiner*—Jennifer R. Dougherty
*Attorney, Agent, or Firm*—Morris N. Reinisch; Howrey Simon Arnold & White

[57] ABSTRACT

The present invention relates to an apparatus and method for selectively lifting produced fluid, including produced hydrocarbons and a portion of produced water, to a ground surface and for multiplying a hydrostatic head of a column of the produced fluid into a magnified injection pressure for injecting, without lifting to the ground surface, the remaining produced water, subsurface, in a subterranean well.

17 Claims, 12 Drawing Sheets

TRIPLE ACTION PUMPING SYSTEM WITH PLUNGER VALVES

The present application is a continuation-in-part of application Ser. No. 09/108,505, filed Jul. 1, 1998, which claims priority to provisional application 60/059,779, filed Sep. 23, 1997, the entirety of each of which is herein incorporated by reference.

BACKGROUND OF THE INVENTION

1. Field of the Invention

The present invention relates to an apparatus and method for improving the economics of hydrocarbon production from a producing well. In particular, the present invention relates to an apparatus and method for selectively lifting produced fluid, including produced hydrocarbons and a portion of produced water, to the ground surface and for injecting the remaining produced water, subsurface, in a subterranean well.

2. Related Art

Conventional hydrocarbon production wells have been constructed in subterranean strata that yield both hydrocarbons, such as oil and gas, and an undesired amount of water. These wells are usually lined with heavy steel pipe called "casing" which is cemented in place so that fluids cannot escape or flow along the space between the casing and the well bore wall. In some wells, large amounts of water are produced along with the hydrocarbons from the onset of production. Alternatively, in other wells, relatively large amounts of water can be produced later during the life of the well.

The production of excess water to the ground surface results in associated costs in both the energy to lift, or "produce," as well as the subsequent handling of the excess produced water after it has arrived at the surface. Moreover, the produced water must be disposed of after it has been brought to the ground surface. Surface handling of excess water, in addition, creates risks of environmental pollution from such incidents as broken lines, spills, overflow of tanks, and other occurrences. Accordingly, many oil production fields and wells often rapidly become uneconomic to produce because of excessive water production.

Various apparatuses and methods have been proposed to overcome the problems associated with excess water production and the aforementioned problems associated with lifting, or producing, this water to the ground surface. Several approaches have been used to produce excess water to the ground surface or to avoid producing the excess water to the ground surface by shutting off the water at the entry into the wellbore. Among these means are: installing larger pumps to pump the water to the ground surface; shutting off the water by injecting gels or resins into the formation; and installing mechanical means in the well to interrupt the flow of water into the wellbore. These approaches, however, have not recognized that effective removal of water from oil or gas wells can be accomplished by transferring the accumulated water subsurface to a water-absorbing injection formation.

An evolving approach to the problem of excess water production is to take advantage of the downhole gravity segregation of produced hydrocarbons and produced water in the wellbore. The excess produced water is then conveyed into an injection formation of the subterranean strata while the oil, for example, and a portion of the produced water are produced, or "lifted," to the ground surface. Such an approach has generally been referred to as an "in-situ" injection method. The conveyance downhole of produced water, without having lifted it to the ground surface, can substantially reduce lease operation costs, thereby extending the economic life of entire fields.

Generally, in-situ methods have required the availability of a suitable injection formation, either below or above the production zone, with sufficient permeability to permit injection of the excess water into the injection formation. In addition, these methods have generally been used where the injection pressure gradients of the candidate injection formations were either low or moderate (i.e., less than 0.5 psi per foot of depth). Practical limitations of the existing equipment and prohibitive costs associated with more expensive and complex pumping equipment have usually restricted use of these in-situ methods where a higher injection pressure gradient field has been encountered.

One example of a conventional production apparatus of the in-situ type is a Dual Action Pumping System ("DAPS") that produces oil and a portion of the water from a casing/tubing annulus on the upstroke of the pump, injects water on the downstroke, and uses the gravity segregation of the oil and water within the annulus. Such an apparatus is shown in U.S. Pat. No. 5,497,832, also assigned to an assignee of the present application, the entirety of which is incorporated herein by reference. Tests of this technology in a number of different wells have shown that gravity segregation of oil and water enable a dual-ported, dual-plunger rod pump to selectively lift produced fluids, including produced hydrocarbons and a portion of produced water, while separating and injecting the remaining produced water into an injection zone within the subterranean strata.

The DAPS apparatus, however, does not solve all of the problems associated with excess water production. In order to overcome the often-encountered moderate to high injection pressures of injection zones, the apparatus requires the use of one or more weighted sinker bars placed above the pump to provide the extra force necessary to overcome the injection pressure opposing the downward movement of the pump. This not only requires more expensive lifting equipment above the pump, but also adds to the overall complexity and cost of the pumping system.

In a further example of the conventional in-situ approach, a coupled rod pump is used for separating and producing oil from water in a well, while simultaneously injecting the water into the producing formation or into an injection formation below the producing formation. Such an apparatus is shown in U.S. Pat. No. 5,697,448. The apparatus employs three spaced packers (upper, middle, and lower). An oil pump is located between the upper and middle packers, and a water pump is located between the middle and lower packers. Produced oil and water are accumulated between the upper and middle packers. The oil is delivered through an opening into the oil pump and fills a cylinder associated with the oil pump. Produced water is allowed to drain through additional passages into the water pump cylinder where it accumulates for injection. Selective pumping of the oil on the upstroke of the pump and the water on the downstroke of the pump is effected by a set of check valves associated with both the oil and water pumps. This apparatus, however, does not provide for, nor is it suited for, injecting water into injection formations with excessive injection pressure gradients.

In another example of an in-situ type apparatus, a formation injection tool, mounted to a bottom-hole tubing pump, carries out underground separation and down-bore in-situ transport and injection of the undesired fluids into an injection formation in the production well. Such an apparatus is shown in U.S. Pat. No. 5,425,416. In order to overcome the often-encountered moderate to high injection pressures of injection zones, this apparatus requires the use of one or more sinker bars placed above the pump to provide the extra force necessary to overcome the injection pressure opposing the downward movement of the pump. In instances where shallow injection zones are encountered, this apparatus requires that numerous sinker bars be used above the pump. This not only requires more expensive lifting equipment above the pump, but also adds to the overall complexity and cost of the pumping system.

Thus, there is a need in the art for an apparatus and method that substantially obviates one or more of the limitations and disadvantages of conventional pumping systems. Particularly, there is a need for a system for lifting produced oil and a portion of the produced water to the ground surface, while injecting the remainder of the produced water into an injection formation. There is a particular need for such a system for injection zones having moderate to high injection pressure gradients.

SUMMARY OF THE INVENTION

The present invention solves the problems with, and overcomes the disadvantages of, conventional pumping systems for lifting produced hydrocarbons and a portion of the produced water to the ground surface following gravity segregation, and for injecting, without lifting to the ground surface, the remaining produced water into a water injection zone.

The present invention relates to an apparatus for selectively lifting produced fluid, including produced hydrocarbons and a portion of produced water to a ground surface and injecting, without lifting to the ground surface, the remaining produced water, subsurface, in a subterranean well. The invention includes a casing having two spaced intervals. The casing extends from the ground surface downwardly within the subterranean well such that a first of the two spaced intervals communicates with the producing zone of a subterranean strata, and a second of the two spaced intervals communicates with the injection zone of the subterranean strata. A pump assembly, reciprocable through an upstroke and a downstroke, is disposed in the casing. The pump assembly includes an upper plunger coupled to a middle plunger, which is, likewise, coupled to a lower plunger. A first valve is preferably disposed on the upper plunger and a second valve is preferably disposed on the middle plunger. The first valve and the second valve are responsive to the upstroke and the downstroke of the pump assembly.

The invention further includes a seal, or packer, that is disposed within the casing between the first and second spaced intervals. The casing and the packer are configured to permit the produced hydrocarbons and water from the producing zone to collect above the packer. The produced hydrocarbons and the produced water segregate by gravity.

Additionally, an inlet is preferably disposed between the lower plunger and the packer. The lower inlet is responsive to the upstroke of the pump assembly to permit unidirectional flow of the produced water segregated by gravity into the pump assembly below the lower plunger to form a column of produced water.

The invention further includes an outlet that is in fluid flow communication with the lower inlet and the pump assembly. The outlet is responsive to the downstroke of the pump assembly to permit unidirectional flow of the column of produced water at the magnified injection pressure into the casing below the packer.

In another aspect, the present invention relates to an apparatus for selectively lifting produced fluid, including produced hydrocarbons and a portion of produced water, to a ground surface and multiplying a hydrostatic head of a column of the produced fluid into a magnified injection pressure for injecting, without lifting to the ground surface, the remaining produced water, subsurface, in a subterranean well.

The invention includes a casing having two spaced intervals and extending from the ground surface downwardly within the subterranean well such that a first of the two spaced intervals communicates with a producing zone and a second of the two spaced intervals communicates with an injection zone. The invention also includes a pump assembly, disposed in the casing, having an upper plunger, a middle plunger, and a lower plunger. The upper plunger is coupled to the middle plunger and the middle plunger is coupled to the lower plunger. The upper plunger has a surface area larger than a surface area of the lower plunger, and the pump assembly is reciprocable through an upstroke and a downstroke.

The invention further includes a first valve disposed on the upper plunger and a second valve disposed on the middle plunger. The first valve and the second valve are responsive to the upstroke and the downstroke of the pump assembly.

The invention further includes a packer disposed within the casing between the first of the two spaced intervals and the second of the two spaced intervals, wherein the casing and the packer are configured to permit the produced fluid to collect above the packer whereby the produced hydrocarbons and produced water segregate by gravity.

The invention further includes a port disposed between the middle plunger and the lower plunger and in fluid flow communication with the produced hydrocarbons and portion of produced water segregated by gravity. Also included is an inlet disposed between the lower plunger and the packer. The inlet is responsive to the upstroke of the pump assembly to permit unidirectional flow of the produced water segregated by gravity into the pump assembly below the lower plunger to form a column of produced water. An outlet is also included. The outlet is preferably in fluid flow communication with the inlet and the pump assembly. The outlet is responsive to the downstroke of the pump assembly to permit unidirectional flow of the column of produced water at the magnified injection pressure into the casing below the packer.

Accordingly, the present invention selectively lifts produced fluid, including produced hydrocarbons and a portion of produced water, to the ground surface. Simultaneously, the present invention uses hydraulic principles to multiply a hydrostatic head of a column of the produced fluid into a magnified injection pressure for injecting, without lifting to the ground surface, the remaining produced water, subsurface, in a subterranean well.

Features and Advantages

The invention provides a simple method and apparatus for lifting produced hydrocarbons and a portion of the produced water to the ground surface while injecting, without lifting to the ground surface, the majority of the produced water into an injection zone within the subterranean strata. The invention uses simple, cost-effective hydraulic principles for multiplying a hydrostatic head of a column of liquid in order to substantially increase the pressure applied to the produced water which enables injection of the produced water into injection zones with moderate to high injection pressure gradients (0.5 psi/ft to 1.5 psi/ft, or more). Moreover, unlike conventional pumping systems, the present invention does not require the use of additional components, like sinker bars, to develop sufficient injection pressures.

Further, when injection pressure gradients are high, the present invention will require less energy and smaller system loads than previous conventional pumping systems. Likewise, the present invention will allow production in waterfloods, such as in the Permian Basin, where injection pressure limitations previously have restricted application of downhole separation. Moreover, the present invention will present opportunities for use in wells with relatively small casing sizes. For example, the present invention may find suitable use in many Eastern Texas wells where a 4-½" diameter casing size is common.

The present invention also has applications with respect to waterflooding deeper zones with excess water produced from shallower zones. In typical waterflood applications, water and oil or gas are produced by conventional methods to a battery where it is separated and temporarily stored. Then the water is pumped through a facility into an injection well. The injection wells are either strategically drilled new wells or existing wells that are converted to the purpose. In particular situations, the desired placement of injection wells is not always possible because of limiting economic factors, such as the location and number of idle wells, injection facility size, reservoir size, pipeline location, etc. The present invention may allow small scale floods or pattern reconfiguration, due to the dual utility of the single well bore, without the attendant costs of surface facilities.

Additional features and advantages of the invention will be set forth in the description that follows, and in part will be apparent from the description, or may be learned in practice of the invention.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiment of this invention is shown in some detail, although it will be apparent to those skilled in the relevant art that some features which are not relevant to the invention may not be shown for the sake of clarity.

Figure 1:
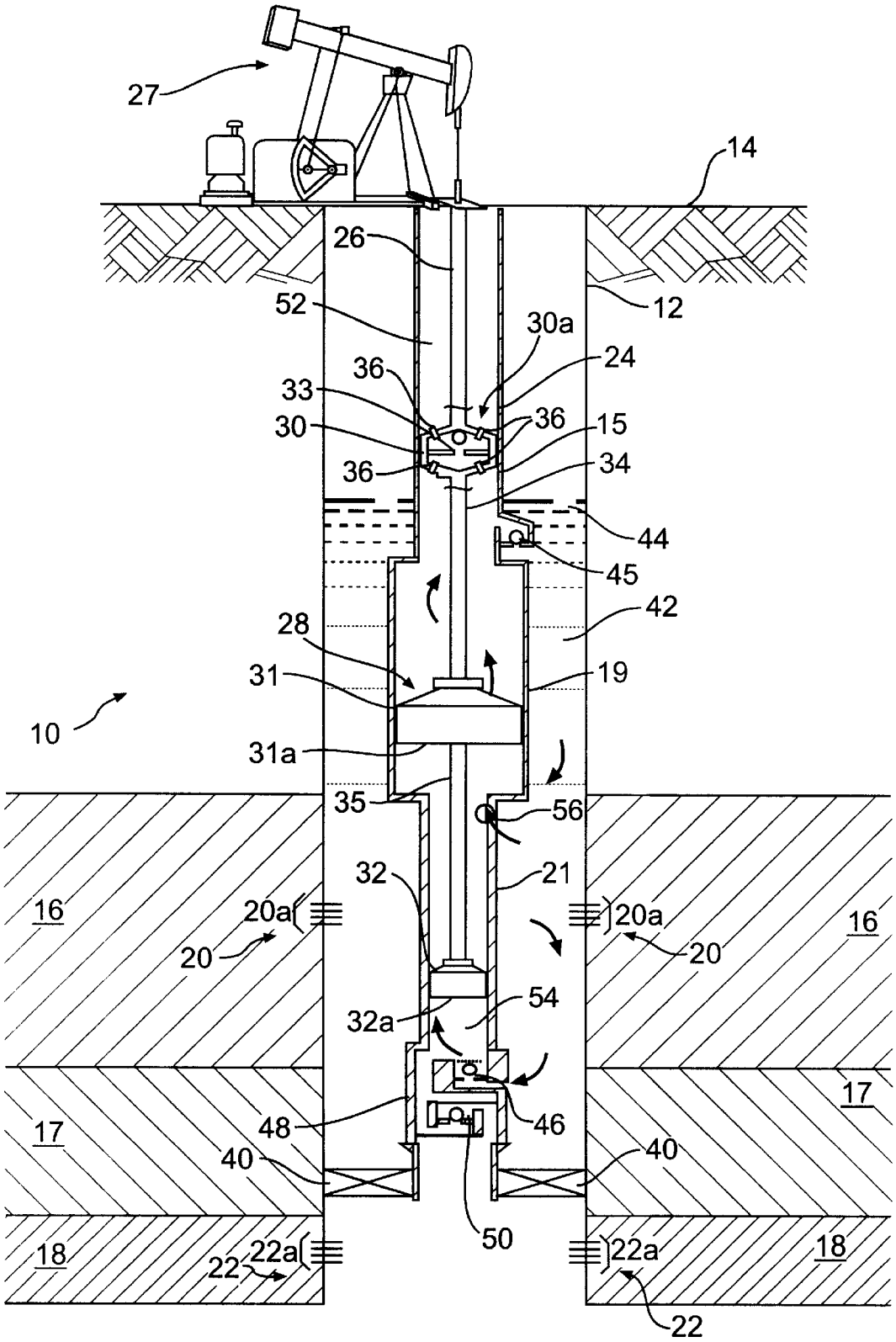
FIG. 1 is a side-elevation sectional view of an embodiment of the present invention shown towards the beginning of its upstroke.

Referring first to FIG. 1, there is illustrated, in a side-elevation sectional view, an exemplary embodiment of the present invention and is represented generally by reference numeral 10. A casing 12 is shown extending from the ground surface 14 downwardly within a subterranean well through a hydrocarbon and water producing zone 16 and then to a water injection zone 18. It should be understood by one of ordinary skill in the art that injection zone 18 may alternatively be referred to as a disposal zone. It is preferable to have a long distance or an isolation zone 17 between the producing zone 16 and the injection zone 18.

As shown in FIG. 1, casing 12 has a producing interval, shown generally at 20, separated from an injection interval, shown generally at 22. Producing interval 20 is located adjacent to and in fluid flow communication with the producing zone 16. In a similar manner, injection interval 22 is located adjacent to and in fluid flow communication with the disposal, or injection zone 18. The producing interval 20 may preferably be for example, but is not limited to, sets of perforations 20*a* in the casing 12 as shown in FIG. 1. Likewise, the injection interval 22 may preferably be, but is not limited to, sets of perforations 22*a* in the casing 12 as shown in FIG. 1. As an alternative, injection interval 22 may be a slotted liner. As a further alternative, instead of using injection interval 22, the excess water may be injected directly into an open hole (not shown) within the subterranean strata. Preferably, however, the injection interval 22 will be sets of perforations 22*a*. It should be readily apparent to one skilled in the art that casing 12 may be provided with multiple producing intervals 20 and injection intervals 22 in communication with the producing zone 16 and the injection zone 18, respectively. The injection zone 18 can be the same formation as the producing zone 16 provided that the producing interval 20 and the injection interval 22 are not communicating actively (i.e., fluid flow is isolated between producing interval 20 and injection interval 22).

Casing 12 surrounds a tubing 24 which extends from the ground surface 14 downwardly within the casing 12. A downhole pump assembly, shown generally as 28, is disposed in casing 12. In the embodiment shown in the Figures, pump assembly 28 is disposed within tubing 24. However, it should be understood that the present invention is not limited to having the pump assembly 28 disposed within tubing 24. It should be apparent to one skilled in the art that pump assembly 28 could consist of any combination of modified rod pumps (including, for example, but not limited to, insert/tubing/insert, insert/insert/insert, and various API pump types) to provide needed flexibility for varying conditions such as sand, gas, and corrosive conditions.

The pump assembly 28 preferably consists of an upper plunger 30, a middle plunger 31, and a lower plunger 32. Upper plunger 30, lower plunger 32, and middle plunger 31 are shown in FIG. 1 as substantially cylindrical in shape, however, it should also be apparent to one skilled in the art that the plungers are not limited to a cylindrical shape. Upper plunger 30 preferably has a larger effective surface area 30*a* as compared to the surface area 32*a* of lower plunger 32. A valve 33 is disposed in the upper plunger 30. Valve 33 is responsive to the upstroke of the pump assembly 28. Additionally, ports 36 are disposed within upper plunger 30. In the exemplary embodiment shown in the Figures, four ports 36 are shown, however, it should be understood by one skilled in the art, that additional ports, or fewer ports may be used. Valve 33 and ports 36 will be discussed in more detail below.

Middle plunger 31 preferably has a larger surface area 31*a* as compared to the surface area 30*a* of upper plunger 30 or surface area 32*a* of lower plunger 32. Surface area 31*a* is preferably larger than surface area 30*a* which is preferably larger than surface area 32*a*. As noted with respect to the shape of the plungers, the surface areas 30*a*, 31*a*, and 32*a* are not limited to a specific shape, although they are preferably circular as shown in FIG. 1. Moreover, the present invention is not limited to having an arrangement wherein surface area 31*a* is larger than surface area 30*a* which is larger than surface area 32*a*. For example, surface area 32*a* may be the same as or larger than surface area 31*a*.

As further shown in FIG. 1, surface area 30*a* is in contact with a column of produced fluid 52 above upper plunger 30 in tubing 24. Likewise, surface area 32*a* is in contact with a column of produced water 54 below lower plunger 32 in tubing 24. The column of produced fluid 52 and the column of produced water 54 will be discussed in more detail below.

The upper plunger 30 and the middle plunger 31 are coupled together by connecting rod 34. Likewise, the middle plunger 31 and the lower plunger 32 are coupled together by connecting rod 35. Connecting rods 34 and 35 are preferably made from steel. Alternatively, connecting rods 34 and 35 may be made of any known high compressive strength material. Connecting rods 34 and 35 may be connected to upper plunger 30 and middle plunger 31, and middle plunger 31 and lower plunger 32, respectively, by any known securing method, for example, but not limited to, threaded connections or welding. The present invention is not limited to the use of connecting rods for coupling upper plunger 30 and middle plunger 31 or middle plunger 31 and lower plunger 32. Accordingly, other suitable mechanisms may be used to couple upper plunger 30, middle plunger 31, and lower plunger 32. In effect, connecting rods 34 and 35 serve to directly connect surface area 30*a* to surface area 32*a* so that the effective pressure (hydraulic head) is transmitted directly. It should be understood by one of ordinary skill in the art that although other forces are present, they have relatively minimal effect on pressure transmission.

In the exemplary embodiment shown in FIG. 1, upper plunger 30, middle plunger 31, and lower plunger 32 are depicted as tubing pumps and, accordingly, are shown sealingly disposed directly within tubing 24. As further shown in FIG. 1, tubing 24 may consist of three varying sized sections, 15, 19, and 21, to accommodate each plunger.

Alternatively, barrels (not shown) corresponding to each plunger may be disposed in tubing 24. In such an alternate embodiment, upper plunger 30, middle plunger 31, and lower plunger 32 are sealingly disposed in each respective barrel within tubing 24. As noted, this provides flexibility in terms of pump sizing and injection pressure magnification options. Preferably, however, upper plunger 30, middle plunger 31, and lower plunger 32 are sealingly disposed within tubing 24. It is to be understood that very little, if any, fluid can pass between the outer sealing edges of upper plunger 30, middle plunger 31, and lower plunger 32 and tubing 24. Any well-known sealing mechanisms may be employed to provide the seal between plungers, 30, 31, and 32, and tubing 24 including, but not limited to o-rings or slip rings.

A sucker rod string 26 is also disposed within tubing 24. Rod string 26 extends to the ground surface 14 where it is reciprocated through an upstroke and a downstroke by a pump drive 27 located at the ground surface 14. Rod string 26 is coupled to upper plunger 30. As discussed above with respect to connecting rod 34, rod string 26 may be coupled to upper plunger 30 by any known securing method, for example, but not limited to, threaded connections or welding. As rod string 26 is reciprocated through an upstroke and a downstroke by the pump drive 27, upper plunger 30, middle plunger 31, and lower plunger 32, likewise reciprocate through an upstroke and downstroke, preferably resulting in a uniform up and down motion within the tubing 24.

A packer 40 is disposed within casing 12, preferably between producing interval 20 and injection interval 22. Casing 12 and packer 40 are configured to permit produced hydrocarbons and produced water to collect above packer 40. By produced hydrocarbons, is meant crude oil, gas, gas condensate, and various combinations thereof. Particularly, tubing 24, casing 12, and packer 40, together define a casing-tubing annulus 42 that extends upward to the ground surface 14. Hydrocarbons, such as oil or gas, and water flow or are "produced," into casing 12 through producing interval 20. The hydrocarbons and water segregate by gravity within casing-tubing annulus 42 forming a hydrocarbon/water interface 44. Gravity segregation, as used herein, is intended to describe the preservation of the isolation between produced hydrocarbons and water, as opposed to separation which indicates that a mixture is mechanically divided into separate fluids. Thus, the produced hydrocarbons and water are allowed to collect in annulus 42 above packer 40 and to segregate by gravity to form segregated produced water below hydrocarbon/water interface 44 and hydrocarbons and a portion of produced water above hydrocarbon/water interface 44. If during production, pump capacity exceeds water production capacity of producing zone 16, then the operator may decrease the pump speed, change the sheaves, put the pump on a timer, or add surface water into the casing-tubing annulus 42 in order to maintain production.

An upper inlet 45 is preferably disposed on tubing 24 between the upper plunger 30 and middle plunger 31. As shown in the exemplary embodiment in FIG. 1, upper inlet 45 may be a ball valve. It should be understood by one of ordinary skill in the art that conventional oil field ball and seat valves are preferred but other suitable valves can be used. Likewise, it should be understood by one of ordinary skill in the art that use of the term "ball valve" herein shall refer to any suitable oil field ball and seat valves or other suitable valves. Upper inlet 45 is responsive to the downstroke of the pump assembly 28 to permit unidirectional flow of the produced oil and a portion of the produced water that has collected above the packer 40 in annulus 42 into the pump assembly 28 between the upper plunger 30 and the middle plunger 31. The operation of upper inlet 45 will be described in more detail below.

A lower inlet 46 is preferably disposed at a lower end of tubing 24 between lower plunger 32 and packer 40. As shown in the exemplary embodiment in FIG. 1, lower inlet 46 may be a ball valve which is assembled as an upper valve of a lower valve assembly, shown generally as 48, having an upper and lower portion. It should be understood by one of ordinary skill in the art that conventional oil field ball and seat valves are preferred but other suitable valves can be used. Lower valve assembly 48 is shown as being preferably connected to the lower end of tubing 24 and to packer 40. It is to be understood, however, that lower valve assembly 48 may be disposed anywhere below the pump assembly 28 provided that it is placed lower than the producing interval 20 but above the packer 40. This placement could range from just a few feet to thousands of feet deeper in the well than the pump assembly 28 itself. It may also be preferred to dispose a check valve (not shown) at the lower end of tubing 24 below lower valve assembly 48 in order to prevent backflow of fluid from the high pressure injection zone when pump assembly 28 and/or lower valve assembly 48 are removed for maintenance or other similar procedures.

In the embodiment shown in the Figures, an outlet 50 is disposed at a lower end of tubing 24 below lower inlet 46 and is in fluid flow communication with pump assembly 28 and with lower inlet 46. As would be readily apparent to one of ordinary skill in the relevant art, lower inlet 46 and outlet 50 can be configured in other arrangements and relative positions. It should be understood that the present invention is not limited to the configuration of lower inlet 46 and outlet 50 shown in the Figures. For example, lower inlet 46 and outlet 50 may be configured in a side-by-side arrangement.

As shown in the exemplary embodiment, fluid flows between lower inlet 46 and outlet 50 in a serpentine path, however, other fluid flow paths may alternatively be used. Outlet 50 is shown in the exemplary embodiment of FIG. 1 as a ball valve assembled as a lower valve of lower valve assembly 48. It will be apparent to those skilled in the art that conventional oil field ball and seat valves are preferred but other types of flow control devices could be used as upper inlet 45, lower inlet 46 or outlet 50. Preferably, however, upper inlet 45, lower inlet 46 and outlet 50 are ball valves and will be referred to below as upper inlet ball valve 45, lower inlet ball valve 46, and outlet ball valve 50, respectively. Operation of upper inlet ball valve 45, lower inlet ball valve 46, and outlet ball valve 50 will be shown in more detail below.

Figure 2:
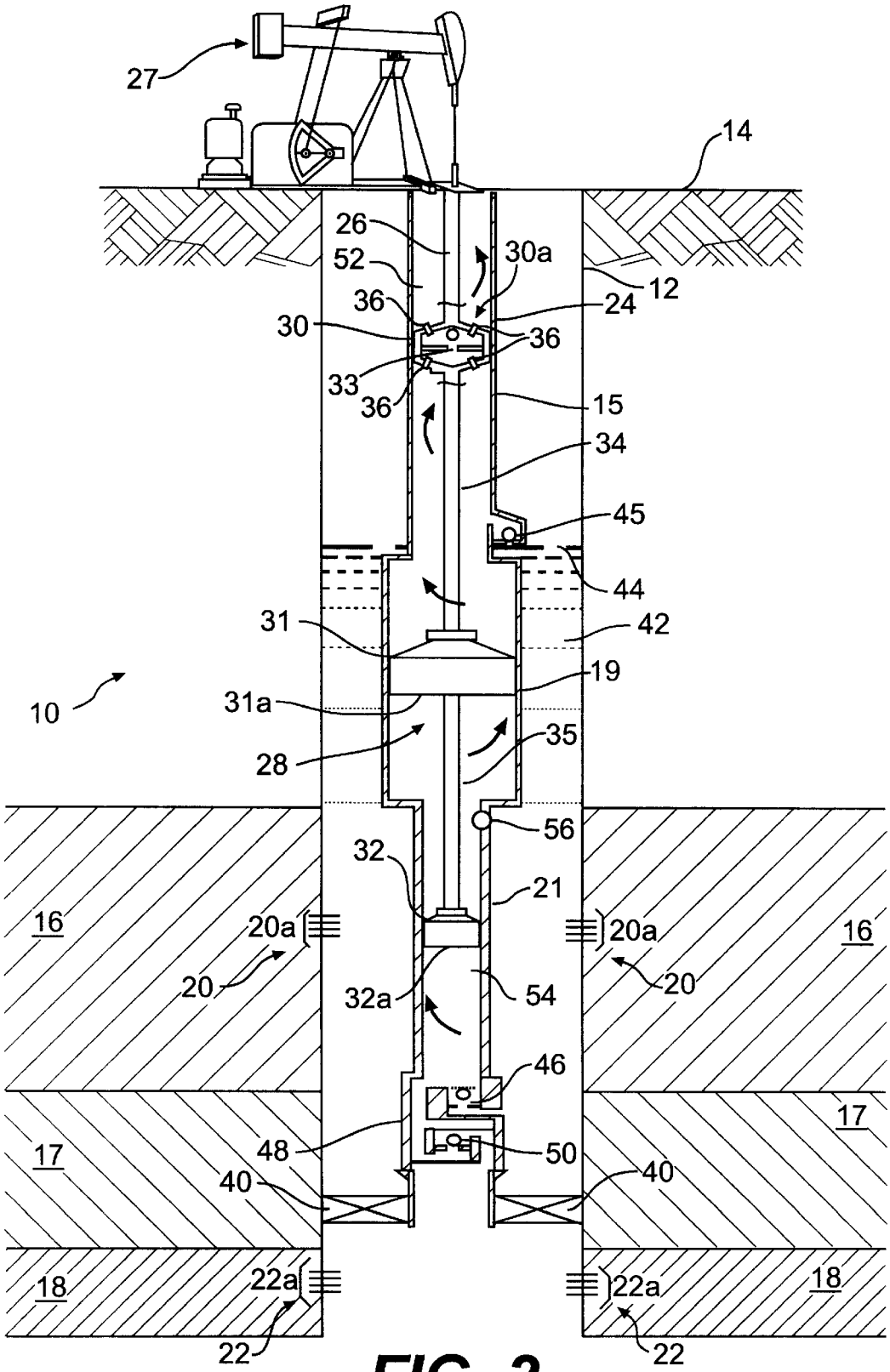
FIG. 2 is a side-elevation sectional view of the embodiment of FIG. 1 shown towards the middle of its upstroke.
Figure 3:
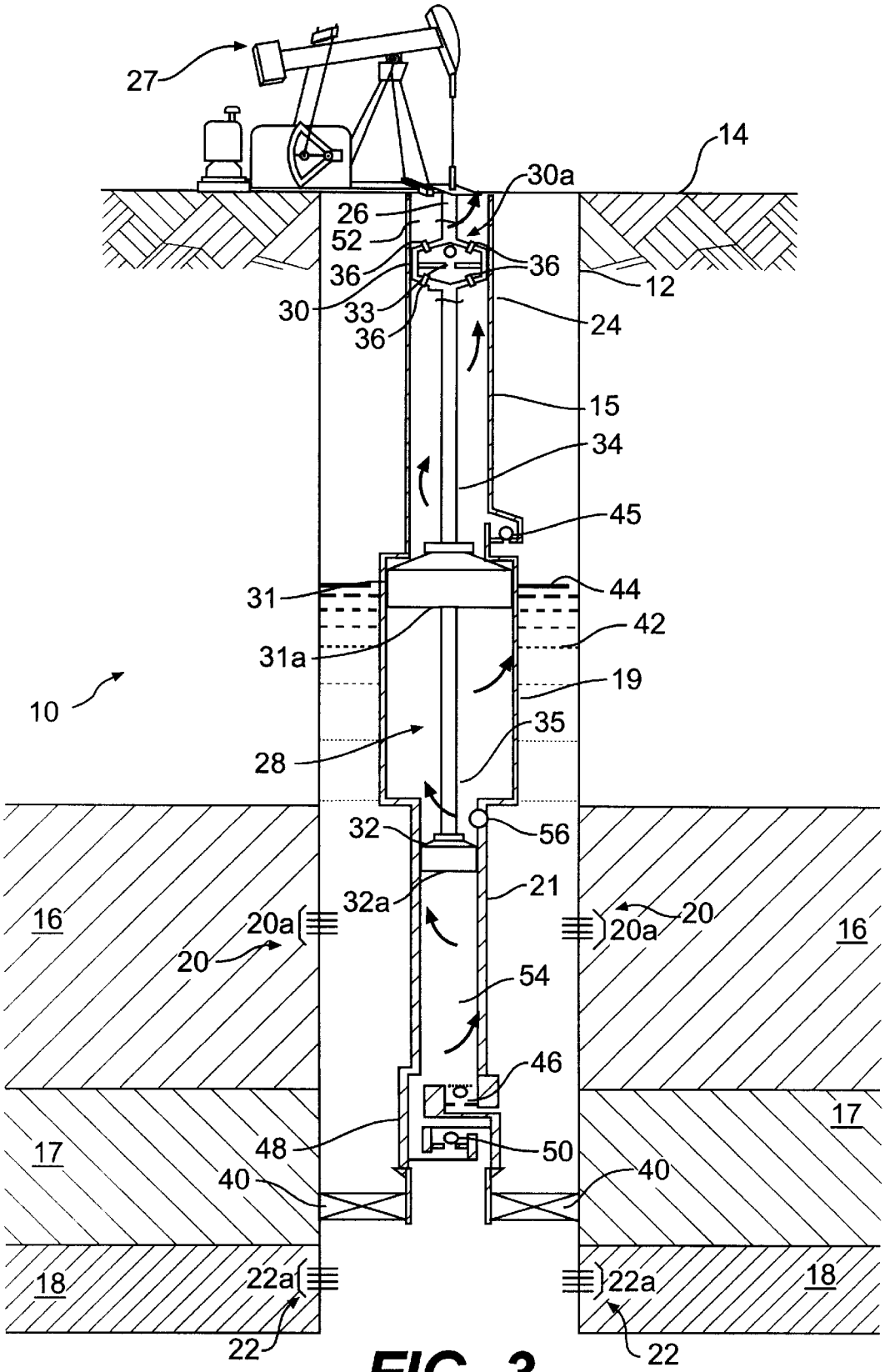
FIG. 3 is a side-elevation sectional view of the embodiment of FIG. 1 shown towards the end of its upstroke.

Referring now to FIGS. 1, 2, and 3 simultaneously, the upstroke, or lifting cycle, of the exemplary embodiment is shown. At the beginning of the upstroke of pump assembly 28, outlet ball valve 50 closes because the pressure being exerted by the disposal or injection zone 18 below packer 40 in casing 12 is greater than the total pressure within tubing 24 below lower plunger 32. This in effect seals off the injection/disposal zone below packer 40.

During the upstroke, lower inlet ball valve 46 opens to permit the segregated produced water to preferably enter below pump assembly 28 within tubing 24. The segregated produced water accumulates below lower plunger 32 within tubing 24 forming a column of produced water 54. At the same time, upper inlet ball valve 45 closes and middle plunger 31 displaces produced fluid (i.e., produced hydrocarbons and a portion of the produced water) between the upper plunger 30 and middle plunger 31 opening valve 33 in upper plunger 30. The produced fluid flows through ports 36 in upper plunger 30 and open valve 33 forming a column of produced fluid 52 above upper plunger 30. As the upstroke of pump assembly 28 continues, a portion of the column of produced fluid 52 is lifted to the ground surface 14 and collected in a well-known manner. Additionally, a portion of the produced fluid accumulated in annulus 42 enters an open port 56 disposed in tubing 24 between middle plunger 31 and lower plunger 32. This action continues, as shown in FIGS. 2 and 3, as rod string 26 lifts the pump assembly 28 within tubing 24.

Figure 4:
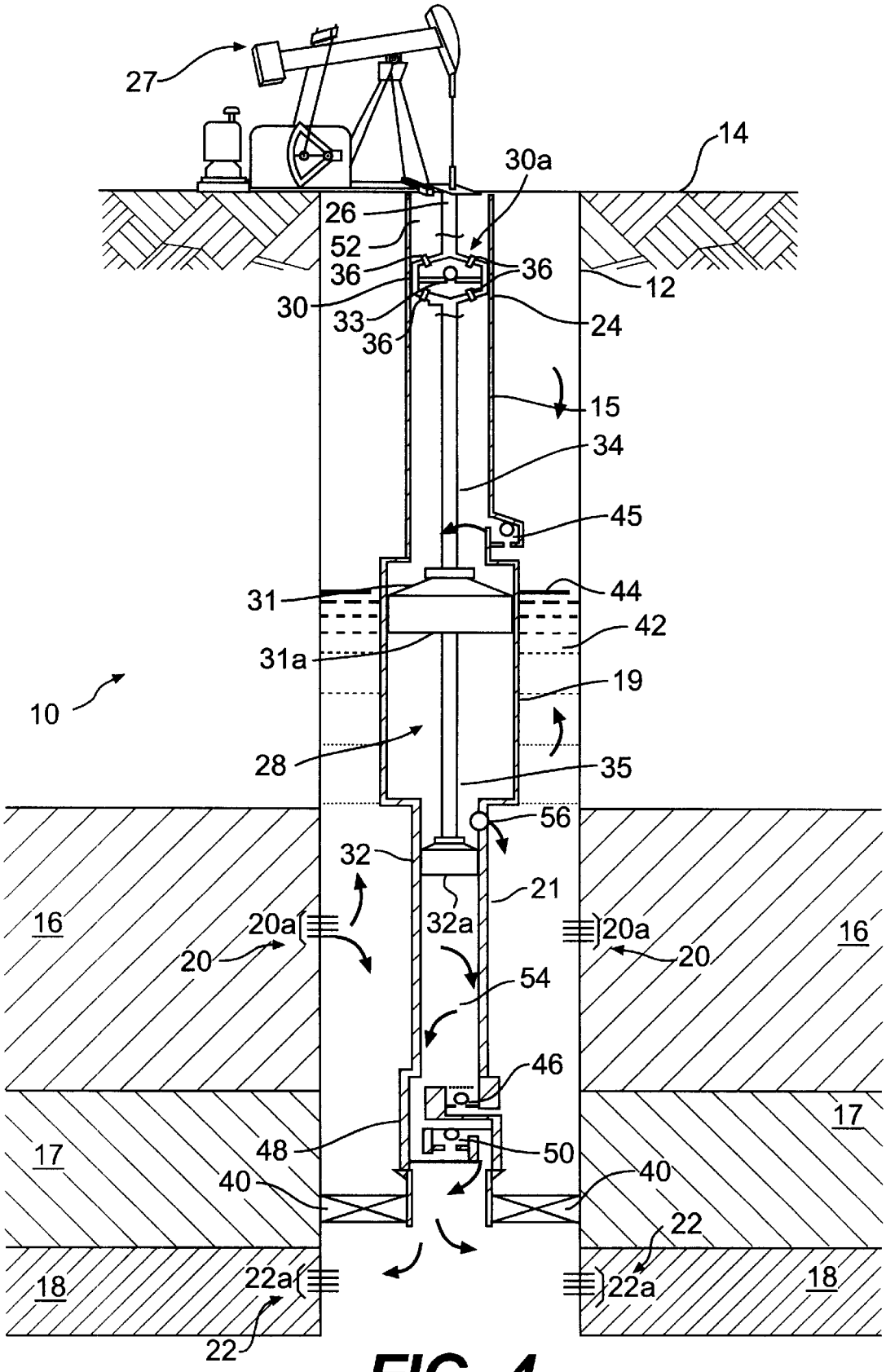
FIG. 4 is a side-elevation sectional view of the embodiment of FIG. 1 shown towards the top of its downstroke.
Figure 5:
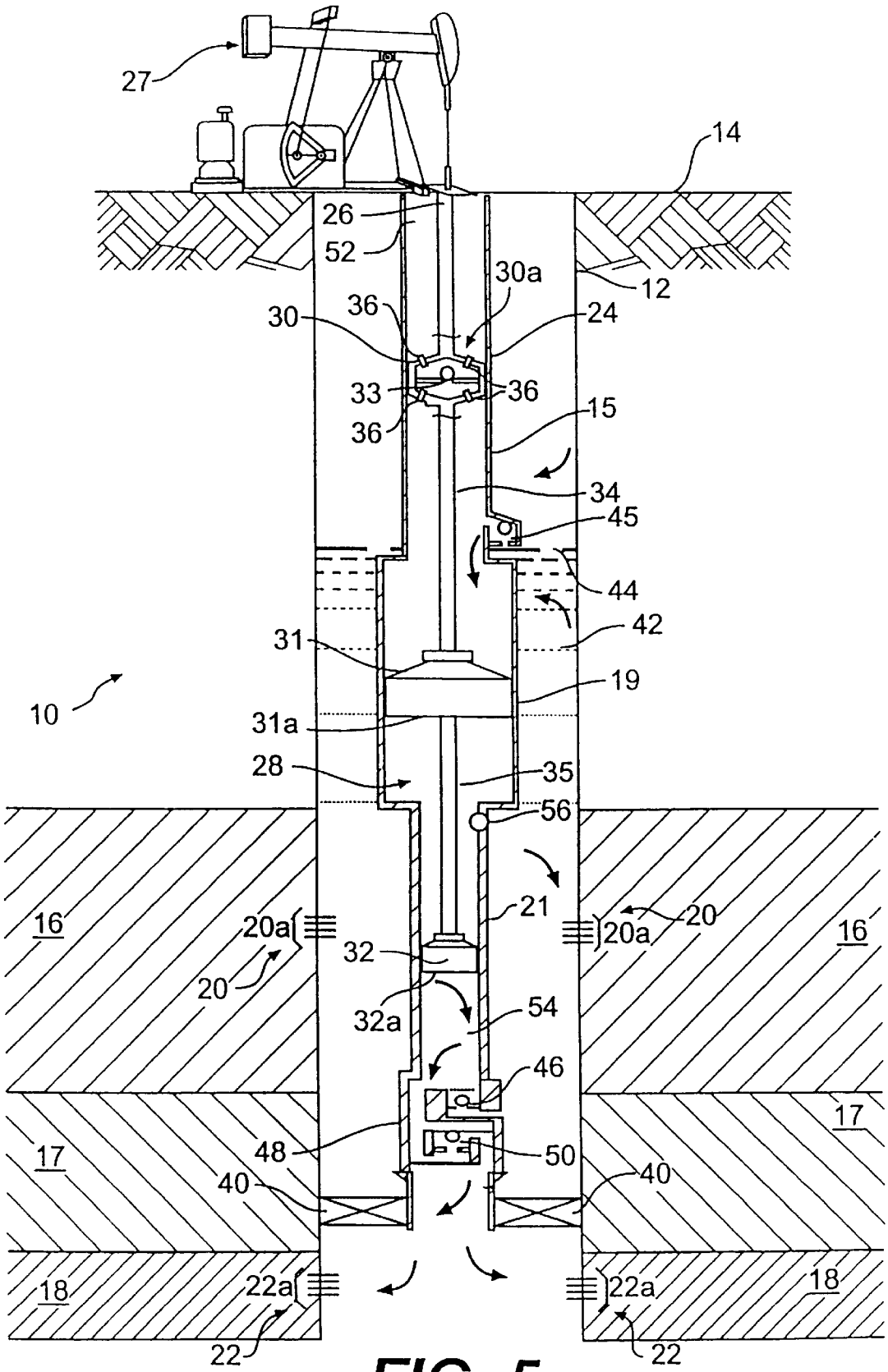
FIG. 5 is a side-elevation sectional view of the embodiment of FIG. 1 shown towards the middle of its downstroke.
Figure 6:
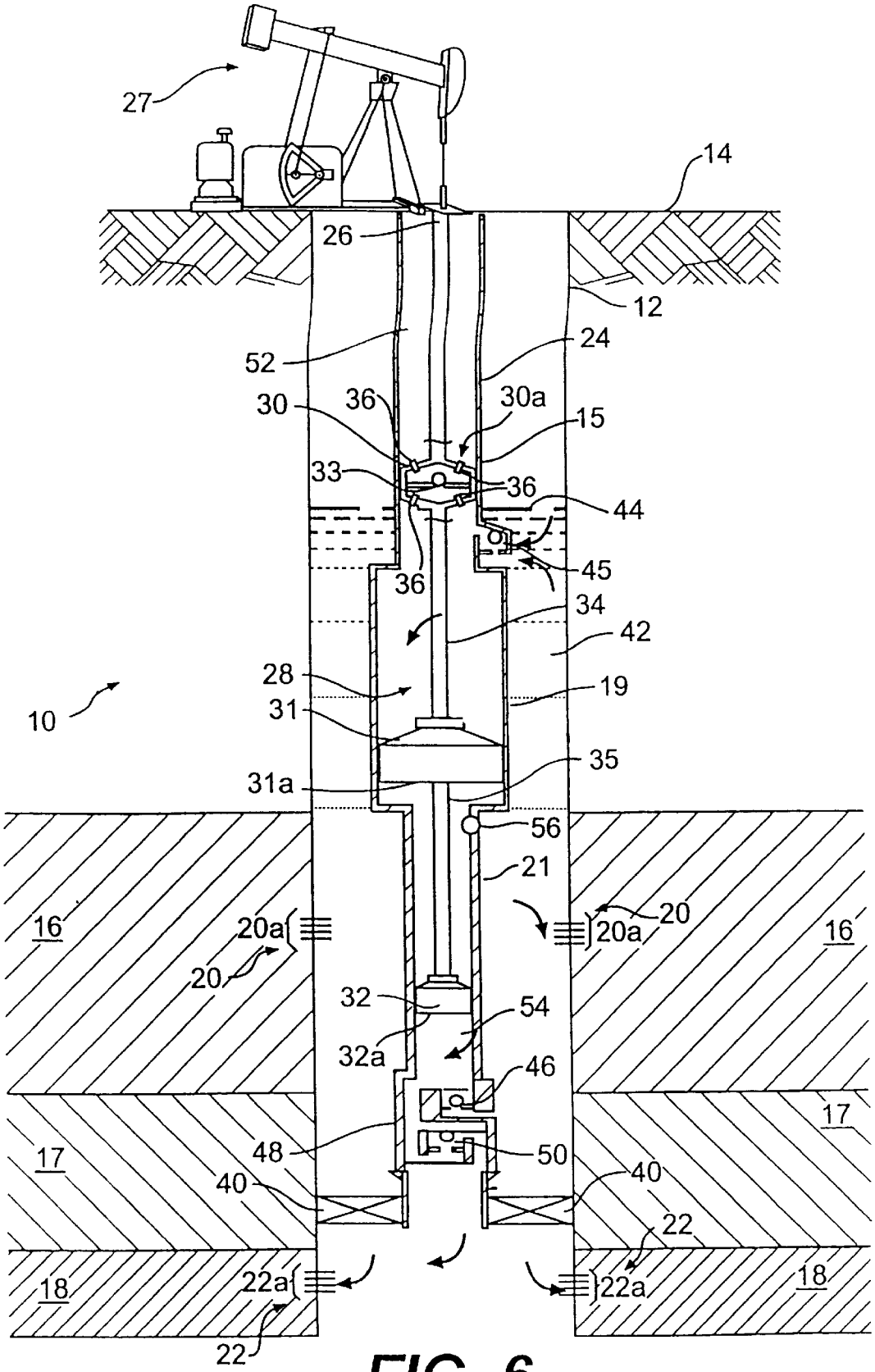
FIG. 6 is a side-elevation sectional view of the embodiment of FIG. 1 shown towards the bottom of its downstroke.

Referring now to FIGS. 4, 5, and 6 simultaneously, the downstroke, or injection cycle, of the exemplary embodiment is shown. At the top of the downstroke (FIG. 4), lower inlet ball valve 46 closes and outlet ball valve 50 opens due to the high pressure generated by bottom plunger 32 acting on the column of produced water 54. At the same time, valve 33 in upper plunger 30 closes.

During the downstroke, the hydrostatic head of the column of produced fluid 52 above upper plunger 30 acts across its surface area 30*a* and this pressure is converted into a downward force in a well known manner (i.e. pounds/square inch*square inches=pounds). This downward force is added to the force imparted by rod string 26 and is transferred through connecting rod 34 and middle plunger 31, to connecting rod 35. The force is then transferred through connecting rod 35 to bottom plunger 32. The force is converted back to a higher pressure, or magnified injection pressure, when the smaller surface area 32*a* of the bottom plunger 32 acts on the column of produced water 54 below. As mentioned above, outlet ball valve 50 is open during the downstroke thereby permitting the column of produced water 54 to exit at the magnified injection pressure via outlet ball valve 50 into casing 12 below packer 40 and thereafter into the injection zone 18.

Also during the downstroke, produced fluid accumulated in the annulus 42 (i.e., produced hydrocarbons and a portion of the produced water) enter the tubing 24 through the upper inlet ball valve 45 between the upper plunger 30 and the middle plunger 31. This produced fluid provides the hydrostatic head which is multiplied by the pump arrangement for magnifying the injection pressure and the produced fluid is lifted to the ground surface 14 as described above. Also during the downstroke, a portion of the produced fluid that entered open port 56 between middle plunger 31 and lower plunger 32 during the upstroke is expelled through open port 56 on the downstroke. This minimizes the counterproductive pressure effects of the larger middle plunger 31 by allowing fluid trapped between middle plunger 31 and lower plunger 32 to be expelled on the downstroke, or injection cycle. This action continues, as shown in FIGS. 5 and 6, until the bottom of the downstroke is reached.

Figure 7:
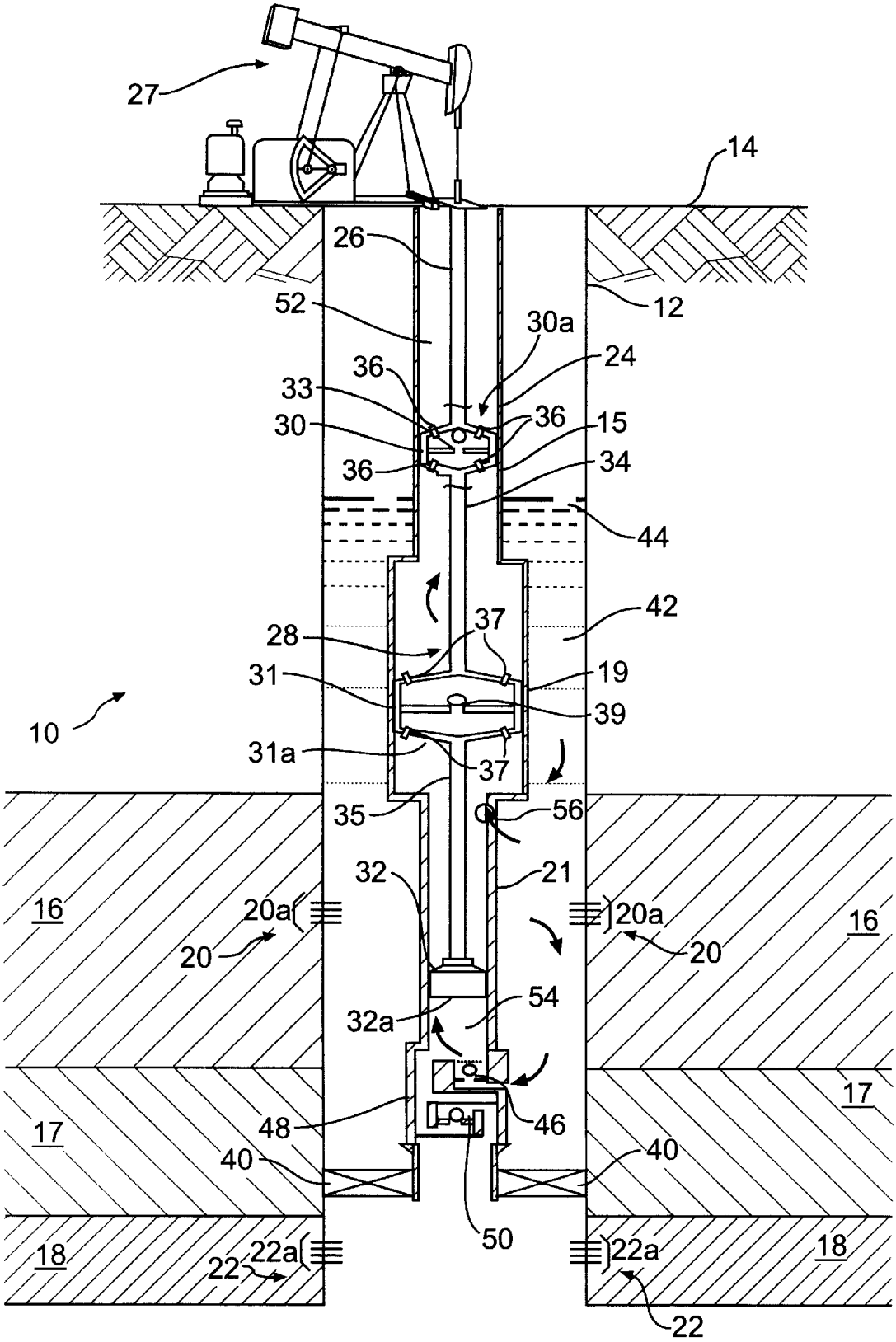
FIG. 7 is a side-elevation sectional view of a second embodiment of the present invention shown towards the beginning of its upstroke.

Referring now to FIG. 7, there is illustrated, in a side-elevation sectional view, a second embodiment of the present invention and is represented generally by reference numeral 10. Like reference numerals will be used where appropriate to describe similar elements to those of the embodiment shown in FIGS. 1–6. Likewise, in as much as similar elements have been described above, for the sake of brevity, such descriptions are herein incorporated by reference.

As shown in FIG. 7, pump assembly 28 preferably consists of an upper plunger 30, a middle plunger 31, and a lower plunger 32. Upper plunger 30, lower plunger 32, and middle plunger 31 are shown in FIG. 7 as substantially cylindrical in shape, however, it should also be apparent to one skilled in the art that the plungers are not limited to a cylindrical shape. Upper plunger 30 preferably has a larger surface area 30*a* as compared to the surface area 32a of lower plunger 32. Depending upon the desired injection pressure, or the volume of fluid to be produced to the ground surface, upper plunger 30 may also have a smaller surface area 30*a* as compared to the surface area 32*a* of lower plunger 32, or alternatively, the surface areas may be the same. In addition, a first valve 33 is preferably disposed on upper plunger 30. First valve 33 is responsive to the upstroke and downstroke of pump assembly 28. Additionally, ports 36 are disposed within upper plunger 30. In the exemplary embodiment shown in the Figures, four ports 36 are shown, however, it should be understood by one skilled in the art, that additional ports, or fewer ports may be used. First valve 33 and ports 36 will be discussed in more detail below.

Middle plunger 31 preferably has a larger surface area 31*a* as compared to the surface area 30*a* of upper plunger 30 or surface area 32*a* of lower plunger 32. Surface area 31*a* is preferably larger than surface area 30*a* which is preferably larger than surface area 32*a*. Depending upon the desired injection pressure, or the volume of fluid to be produced to the ground surface, middle plunger 31 may also have a smaller surface area 31*a* as compared to the surface area 32*a* of lower plunger 32 or the surface area 30*a* of upper plunger 30, or alternatively, the surface areas may be the same. A second valve 39 is preferably disposed on middle plunger 31. Second valve 39 is responsive to the upstroke and the downstroke of pump assembly 28. Additionally, ports 37 are disposed within middle plunger 31. In the exemplary embodiment shown in the Figures, four ports 37 are shown, however, it should be understood by one skilled in the art, that additional ports, or fewer ports may be used. Second valve 39 and ports 37 will be discussed in more detail below.

As noted with respect to the shape of the plungers, the surface areas 30*a*, 31*a*, and 32*a* are not limited to a specific shape, although they are preferably circular as shown in FIG. 7. As further shown in FIG. 7, surface area 30*a* is in contact with a column of produced fluid 52 above upper plunger 30 in tubing 24. Likewise, surface area 32*a* is in contact with a column of produced water 54 below lower plunger 32 in tubing 24. The column of produced fluid 52 and the column of produced water 54 will be discussed in more detail below.

The upper plunger 30 and the middle plunger 31 are coupled together by connecting rod 34. Likewise, the middle plunger 31 and the lower plunger 32 are coupled together by connecting rod 35. Connecting rods 34 and 35 are preferably made from steel. Alternatively, connecting rods 34 and 35 may be made of any known high compressive strength material. Connecting rods 34 and 35 may be connected to upper plunger 30 and middle plunger 31, and middle plunger 31 and lower plunger 32, respectively, by any known securing method, for example, but not limited to, threaded connections or welding. The present invention is not limited to the use of connecting rods for coupling upper plunger 30 and middle plunger 31 or middle plunger 31 and lower plunger 32. Accordingly, other suitable mechanisms may be used to couple upper plunger 30, middle plunger 31, and lower plunger 32. In effect, connecting rods 34 and 35 serve to directly connect surface area 30*a* to surface area 32*a* so that the effective pressure (hydraulic head) is transmitted directly. It should be understood by one of ordinary skill in the art that although other forces are present, they have relatively minimal effect on pressure transmission.

An inlet 46 is preferably disposed at a lower end of tubing 24 between lower plunger 32 and packer 40. As shown in the exemplary embodiment in FIG. 7, inlet 46 may be a ball valve which is assembled as an upper valve of a lower valve assembly, shown generally as 48, having an upper and lower portion. Lower valve assembly 48 is shown as being preferably connected to the lower end of tubing 24 and to packer 40. It is to be understood, however, that lower valve assembly 48 may be disposed anywhere below the pump assembly 28 provided that it is placed lower than the producing interval 20 but above the packer 40. This placement could range from just a few feet to thousands of feet deeper in the well than the pump assembly 28 itself. It may also be preferred to dispose a check valve (not shown) at the lower end of tubing 24 below lower valve assembly 48 in order to prevent backflow of fluid from the high pressure injection zone when pump assembly 28 and/or lower valve assembly 48 are removed for maintenance or other similar procedures.

In the embodiment shown in the Figures, an outlet 50 is disposed at a lower end of tubing 24 below inlet 46 and is in fluid flow communication with pump assembly 28 and with inlet 46. As would be readily apparent to one of ordinary skill in the relevant art, inlet 46 and outlet 50 can be configured in other arrangements and relative positions. It should be understood that the present invention is not limited to the configuration of inlet 46 and outlet 50 shown in the Figures. For example, inlet 46 and outlet 50 may be configured in a side-by-side arrangement.

As shown in the exemplary embodiment, fluid flows between inlet 46 and outlet 50 in a serpentine path, however, other fluid flow paths may alternatively be used. Outlet 50 is shown in the exemplary embodiment of FIG. 7 as a ball valve assembled as a lower valve of lower valve assembly 48. It will be apparent to those skilled in the art that conventional oil field ball and seat valves are preferred but other types of flow control devices could be used as inlet 46, outlet 50, or any of the valves mentioned herein. Preferably, however, inlet 46 and outlet 50 are ball valves and will be referred to below as inlet ball valve 46 and outlet ball valve 50, respectively. Operation of inlet ball valve 46 and outlet ball valve 50 will be described in more detail below.

An open port 56 is preferably disposed in tubing 24 between middle plunger 31 and lower plunger 32. Open port 56 allows produced fluid accumulated in the annulus 42 (i.e., produced hydrocarbons and a portion of the produced water) to enter the tubing 24 between middle plunger 31 and lower plunger 32. Operation of open port 56 will be described in more detail below.

Figure 8:
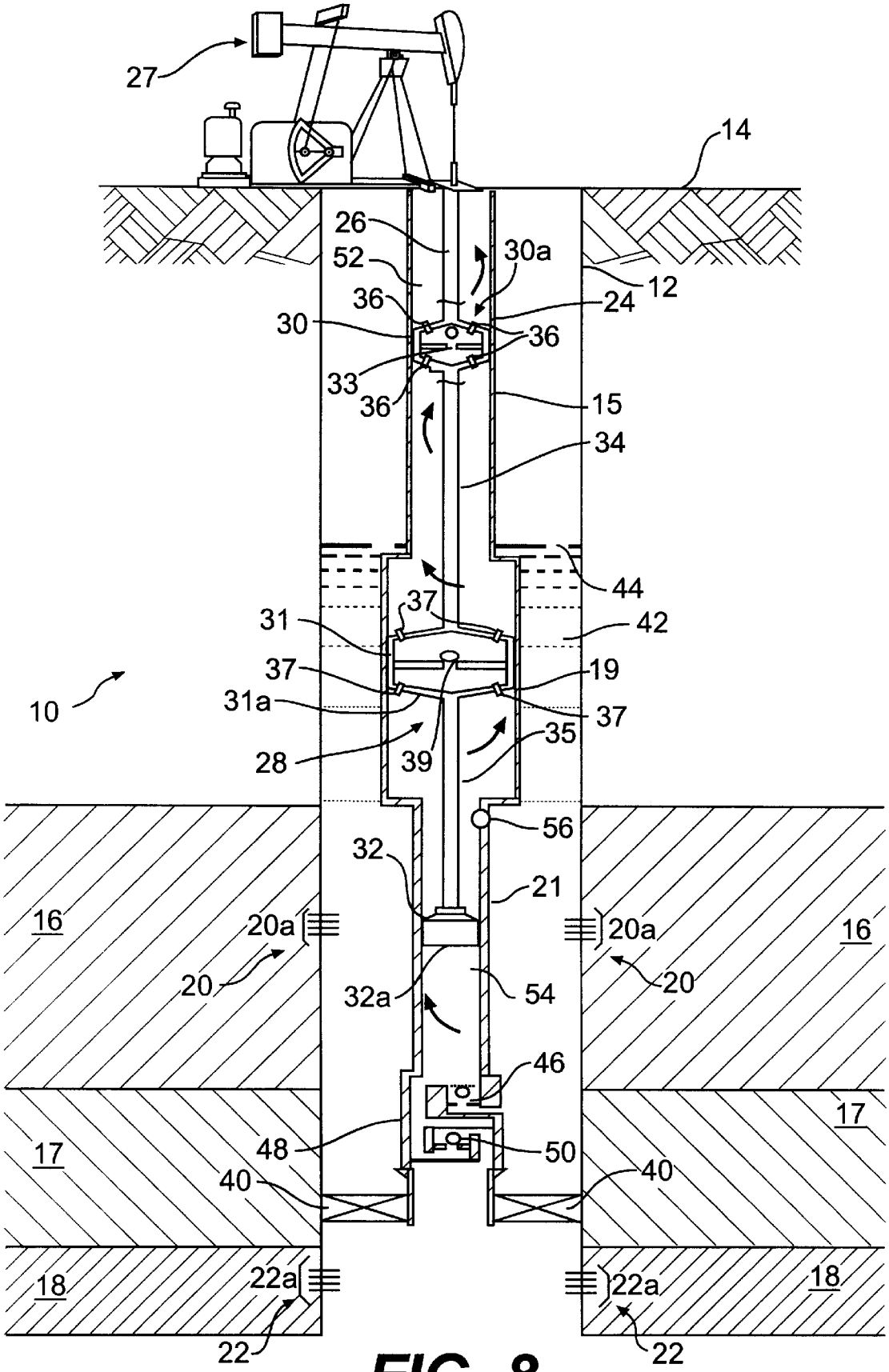
FIG. 8 is a side-elevation sectional view of the embodiment of FIG. 7 shown towards the middle of its upstroke.
Figure 9:
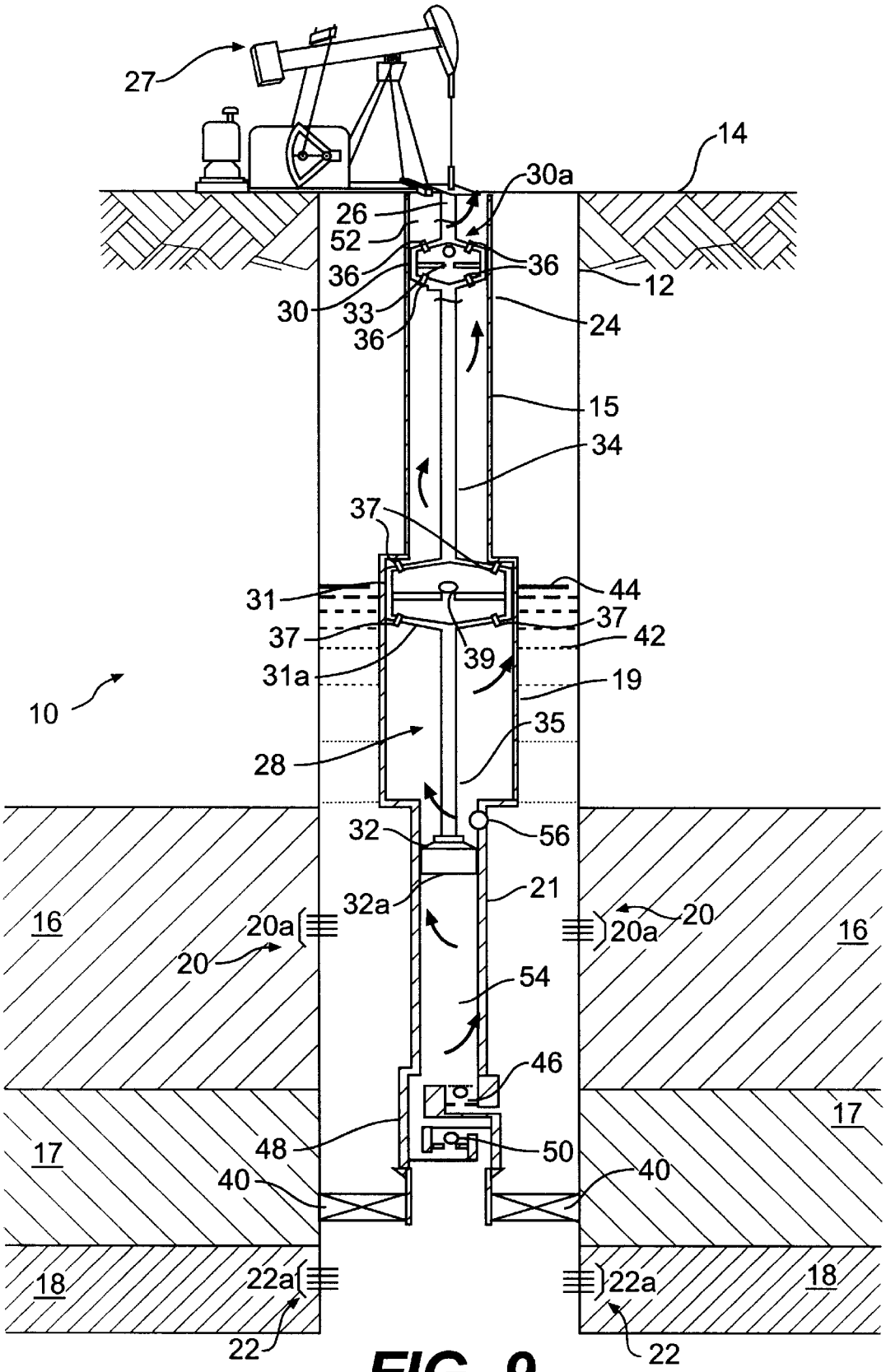
FIG. 9 is a side-elevation sectional view of the embodiment of FIG. 7 shown towards the end of its upstroke.

Referring now to FIGS. 7, 8, and 9 simultaneously, the upstroke, or lifting cycle, of the second exemplary embodiment is shown. At the beginning of the upstroke of pump assembly 28, outlet ball valve 50 closes because the pressure being exerted by the disposal or injection zone 18 below packer 40 in casing 12 is greater than the total pressure within tubing 24 below lower plunger 32. This in effect seals off the injection/disposal zone below packer 40.

During the upstroke, inlet ball valve 46 opens to permit the segregated produced water to enter pump assembly 28 within tubing 24. The segregated produced water accumulates below lower plunger 32 within tubing 24 forming a column of produced water 54. At the same time, second valve 39 disposed on middle plunger 31 closes and middle plunger 31 displaces produced fluid (i.e., produced hydrocarbons and a portion of the produced water) between the upper plunger 30 and middle plunger 31 opening first valve 33 in upper plunger 30. The produced fluid flows through ports 36 in upper plunger 30 and open first valve 33 forming a column of produced fluid 52 above upper plunger 30. As the upstroke of pump assembly 28 continues, a portion of the column of produced fluid 52 is lifted to the ground surface 14 and collected in a well-known manner. Additionally, a portion of the produced fluid accumulated in annulus 42 enters open port 56 between middle plunger 31 and lower plunger 32. This action continues, as shown in FIGS. 8 and 9, as rod string 26 lifts the pump assembly 28 within tubing 24. It should be apparent to one of ordinary skill in the art that a proportion of fluid may be expelled through open port 56 during the upstroke depending upon the pressure differential between the pump chamber and annulus 42.

Figure 10:
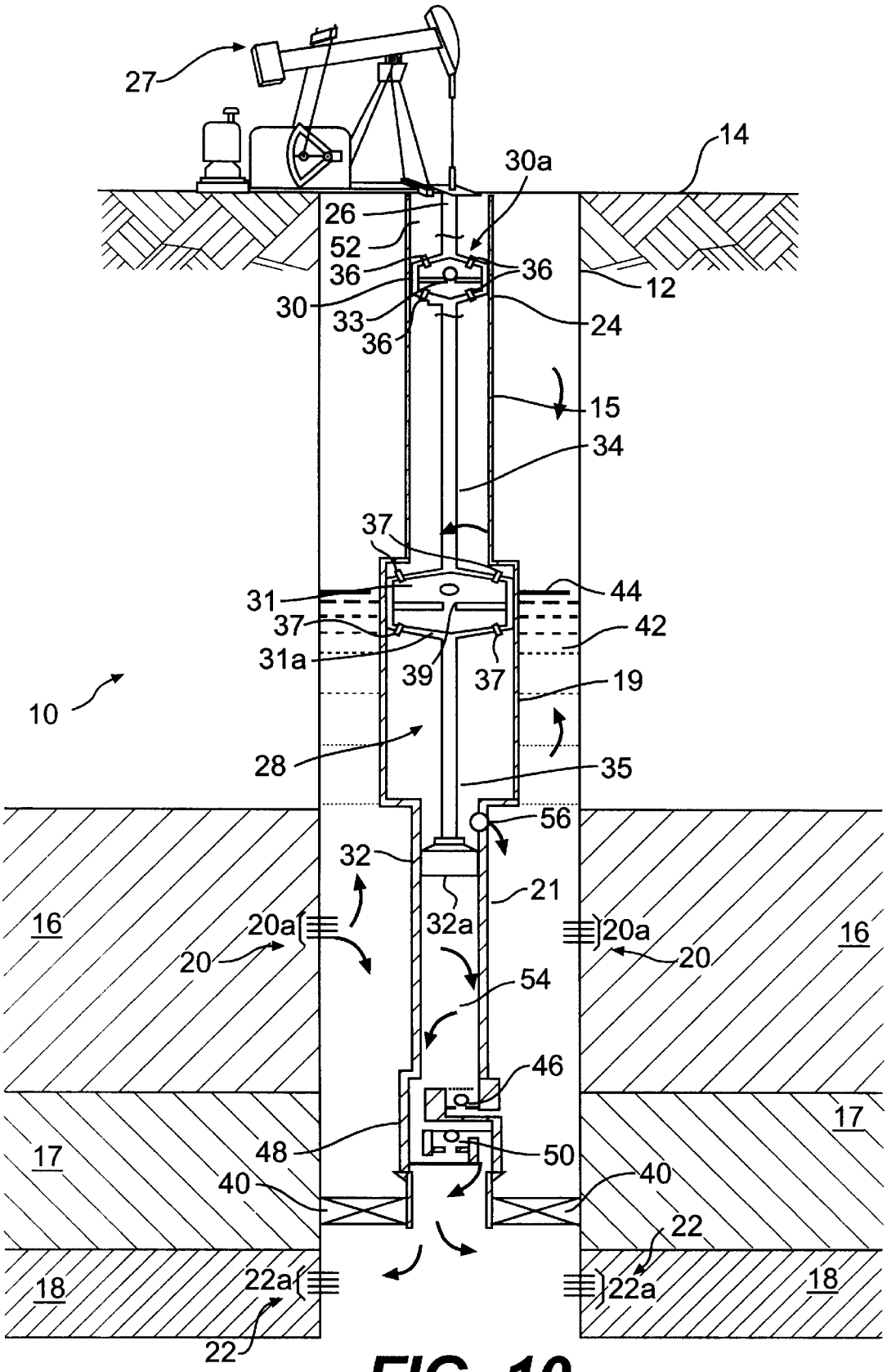
FIG. 10 is a side-elevation sectional view of the embodiment of FIG. 7 shown towards the top of its downstroke.
Figure 11:
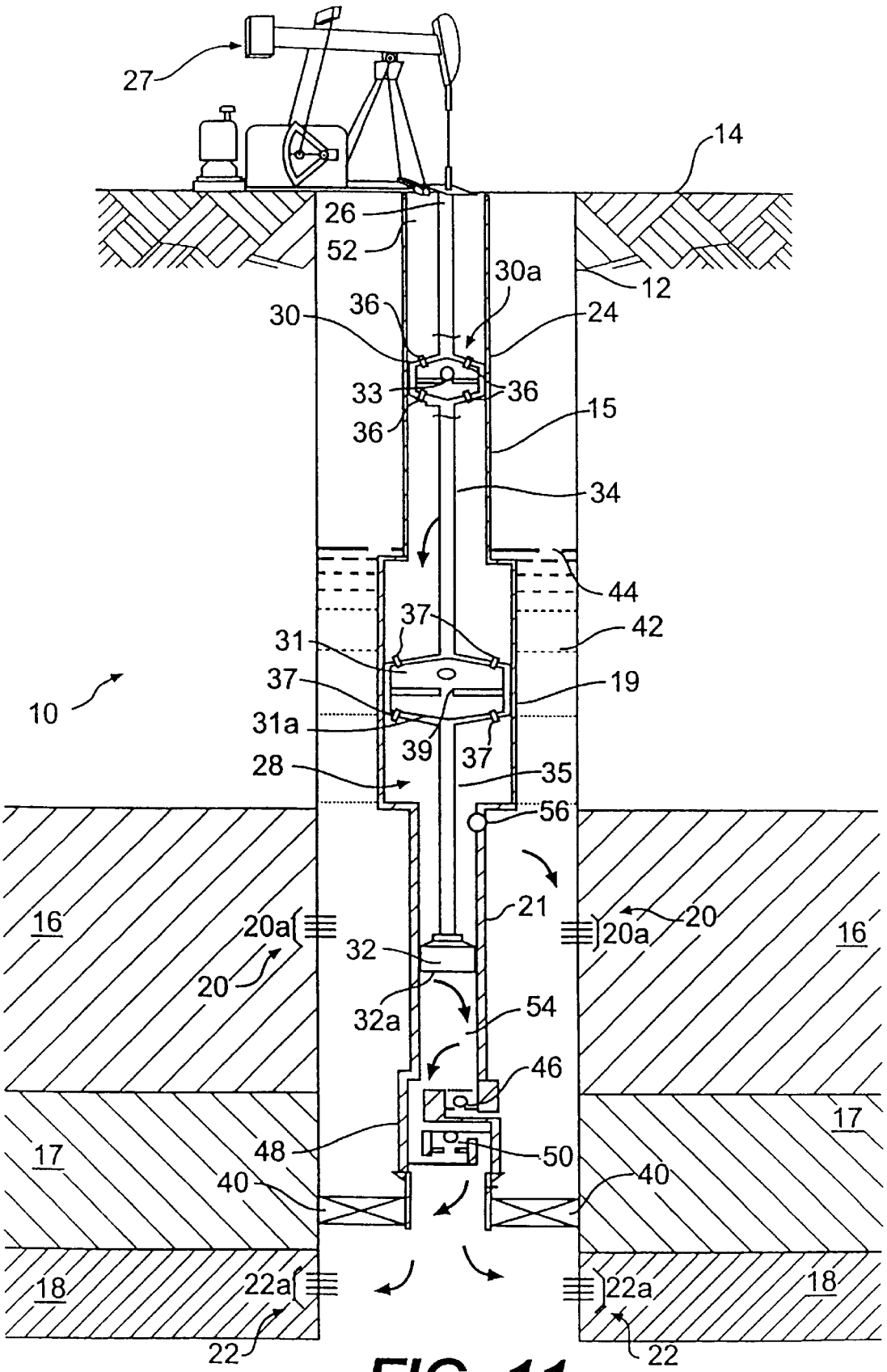
FIG. 11 is a side-elevation sectional view of the embodiment of FIG. 7 shown towards the middle of its downstroke.
Figure 12:
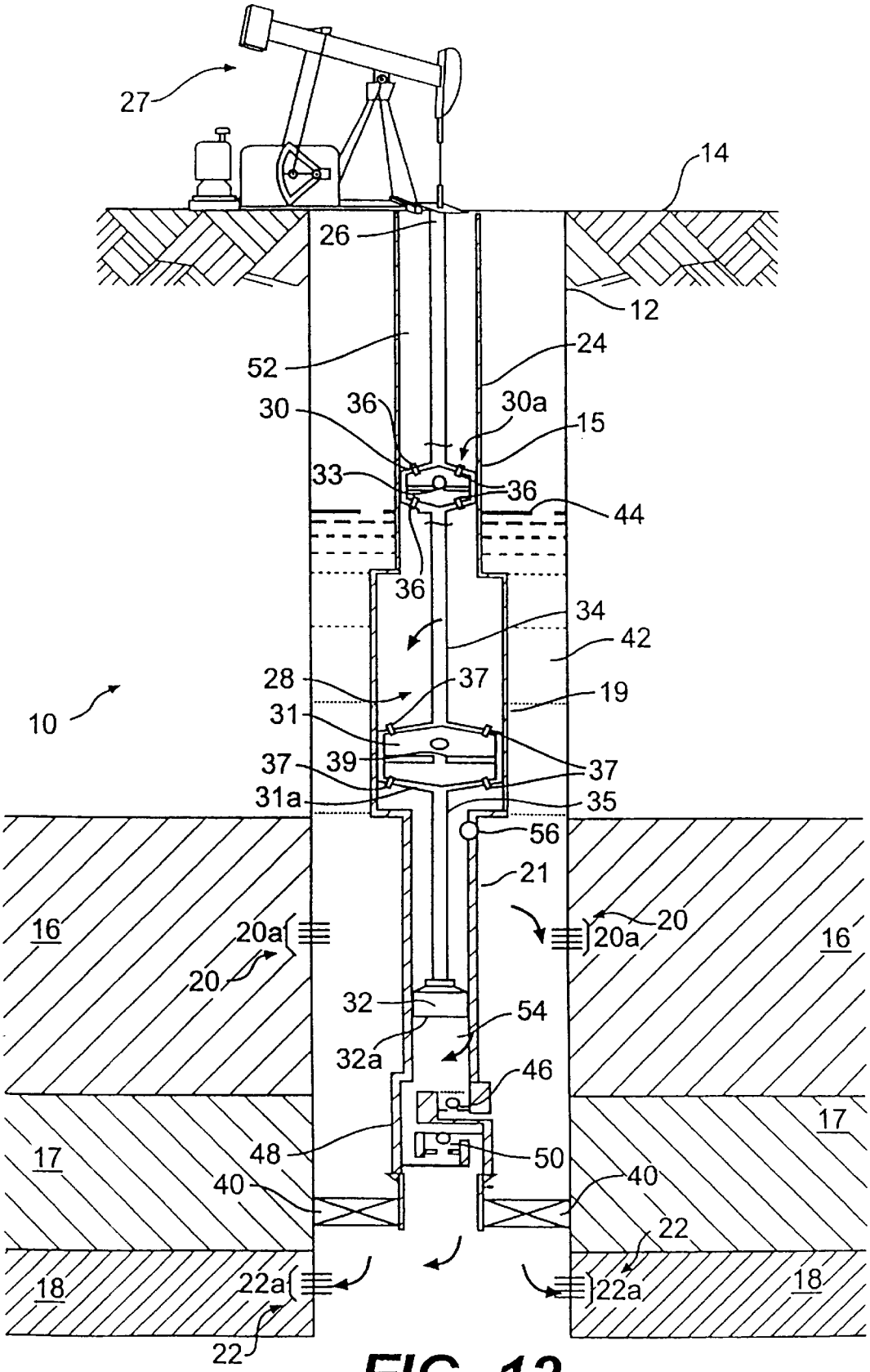
FIG. 12 is a side-elevation sectional view of the embodiment of FIG. 7 shown towards the bottom of its downstroke.

Referring now to FIGS. 10, 11, and 12 simultaneously, the downstroke, or injection cycle, of the second exemplary embodiment is shown. At the top of the downstroke (FIG. 10), inlet ball valve 46 closes and outlet ball valve 50 opens due to the high pressure generated by bottom plunger 32 acting on the column of produced water 54. At the same time, first valve 33 in upper plunger 30 closes and second valve 39 in middle plunger 31 opens.

During the downstroke, the hydrostatic head of the column of produced fluid 52 above upper plunger 30 acts across its surface area 30a and this pressure is converted into a downward force in a well known manner (i.e. pounds/square inch * square inches=pounds). This downward force is added to the force imparted by rod string 26 and is transferred through connecting rod 34 and middle plunger 31, to connecting rod 35. The force is then transferred through connecting rod 35 to bottom plunger 32. The force is converted back to a higher pressure, or magnified injection pressure, when the smaller surface area 32*a* of the bottom plunger 32 acts on the column of produced water 54 below. As mentioned above, outlet ball valve 50 is open during the downstroke thereby permitting the column of produced water 54 to exit at the magnified injection pressure via outlet ball valve 50 into casing 12 below packer 40 and thereafter into the injection zone 18.

Also during the downstroke, a portion of the produced fluid that entered open port 56 between middle plunger 31 and lower plunger 32 during the upstroke flows through ports 37 in middle plunger 31 and open second valve 39. The produced fluid accumulates above middle plunger 31. The produced fluid is then lifted during the upstroke to the ground surface 14 as described above. Also during the downstroke, a portion of the produced fluid that entered open port 56 between middle plunger 31 and lower plunger 32 during the upstroke may be expelled through open port 56. This action continues, as shown in FIGS. 11 and 12, until the bottom of the downstroke is reached. It should be understood by one of ordinary skill in the art that a proportion of fluid may enter open port 56 during the upstroke depending upon the pressure differential between the pump chamber and annulus 42.

To more clearly describe the injection pressure magnification process, the following example is given. It is to be understood that the prophetic calculations shown below are simplified to describe the primary factors (e.g., fluid level in casing-tubing annulus 42) involved in calculating the magnified injection pressure. As would be apparent to one of ordinary skill in the art, other secondary factors, such as buoyancy, casing pressure, and the dynamic effects of the connecting rod(s) may affect the magnified injection pressure. Likewise, imperfect valves, seals, etc. may affect the overall pressure magnification. During the upstroke of pump assembly 28, the produced fluid between middle plunger 31 and lower plunger 32, which enters through open port 56, provides a slight, net upwards pressure effect due to the pressure in the casing-tubing annulus 42. This example should not represent any limitation on the present invention. Corresponding reference numerals will be used where appropriate.

Consider an oil-producing well located in a particular field wherein the producing zone 16 is located approximately 2,000 feet from the surface. Assuming the hydrostatic pressure gradient of the column of produced fluid (i.e., hydrocarbons and a portion of the produced water) above the upper plunger 30 is approximately 0.4 psi/foot, the resultant pressure exerted by the column of produced fluid 52 at the upper plunger 30 is 800 psi (2,000 feet*0.4 psi/foot=800 psi). Assume upper plunger 30 has an effective diameter of 1.50 inches, middle plunger 31 has an effective diameter of 2.00 inches, and lower plunger 32 has an effective diameter of 1.25 inches. The corresponding effective surface area 30*a* of the upper plunger 30 is therefore 1.77 $in^2$ ($\pi$*(1.50 in/2)$^2$=1.77 $in^2$). Similarly, the corresponding effective surface area 32*a* of the lower plunger 32 is 1.23 $in^2$ ($\pi$*(1.25 in/2)$^2$=1.23 $in^2$). As described above, during the downstroke of the pump assembly 28, the hydrostatic head (800 psi) acts across surface area 30*a* of upper plunger 30 and is converted into a Force (Force=Head*Surface Area 30*a*=800 psi * 1.77 $in^2$: Force=1,416 pounds). This Force is then transferred through connecting rods 34 and 35 to lower plunger 32 where it is converted back into a magnified injection pressure when the smaller surface area 32*a* of bottom plunger 32 acts on the column of produced water 54 below bottom plunger 32 (Magnified Injection Pressure=Force/Surface Area 32*a*=1,416 pounds/1.23 in) ($^2$: Magnified Injection Pressure=1.151 psi). Thus, the hydrostatic head of 800 psi has been converted to a magnified injection pressure of 1,151 psi, a differential of 351 psi.

Although the larger middle plunger 31 may affect the pressure of the injection cycle, as described above, the ratio of the surface areas of upper plunger 30 to the lower plunger 32 has the most significant effect on the magnified injection pressure. The ratio of the surface areas of middle plunger 31 to the upper plunger 30 does, however, significantly affects the volume of produced fluid lifted to the ground surface 14. Indeed, as the ratio of the surface areas of middle plunger 31 to upper plunger 30 increases, the volume of produced fluid lifted to the ground surface 14 increases accordingly. Therefore, it should be understood by the person of ordinary skill in the relevant art, that a tradeoff exists between the volumetric efficiency of produced fluids to the ground surface 14 and the magnified injection pressure. Such a tradeoff is based upon selection of the particular sized combinations of the upper, middle, and lower plungers, 30, 31, and 32, respectively. It should be understood by one of ordinary skill in the art that while there is a tradeoff of efficiency, the present invention, nevertheless, may have a higher overall efficiency as compared to conventional pumping systems because it works during both the upstroke and the downstroke whereas conventional systems typically work only during the upstroke.

As noted, if it is desired to alter the injection pressure or the volume of produced fluids to the ground surface, different sized plungers or connecting rods may be used. In addition, although not required, any number of conventional sinker bars may be used to alter the design pressure magnification. In some hydrocarbon fields where a conventional pump cannot provide sufficiently high injection pressures, the present invention, as evidenced by the example above, can provide such injection pressures in the range of one to two thousand, or more, pounds per square inch increases over the initial pressure exerted by the column of produced fluid 52. This is especially useful in those fields where the injection or disposal zones exhibit moderate to high hydrostatic pressure gradients which are in excess of 0.5 psi/ft of depth. Indeed, the present invention's benefits increase as injection pressure approaches fracture gradient (0.7 to 1.5 psi/ft or more). Alternatively, the present invention may be used in fields where the injection pressure gradient of the injection zone is less than 0.5 psi/ft with the expectation that injection pressure will increase as the well scales up, builds up pore pressure, etc. This is not unlikely in low permeability injection zones for which this device is advantageously suited.

As described above, and as shown in the above example, the present invention provides a simple system for providing sufficiently high injection pressures while simultaneously lifting produced hydrocarbons and only a portion of the produced water to the ground surface. It should be apparent that the present invention may be used to increase efficiency and production, to lower production, injection, and equipment costs, and to extend the overall commercial life of hydrocarbon producing fields that are currently uneconomic for production, either because of unsuitable water injection zones subsurface or due to practical limitations of existing equipment.

Conclusion

While various embodiments of the present invention have been described above, it should be understood that they have been presented by way of example only, and not limitation. Thus, the breadth and scope of the present invention should not be limited by any of the abovedescribed exemplary embodiments, but should be defined only in accordance with the following claims and their equivalents.

We claim:

1. An apparatus for selectively lifting produced fluid, including produced hydrocarbons and a portion of produced water, to a ground surface and injecting, without lifting to the ground surface, the remaining produced water, subsurface, in a subterranean well comprising:

a casing having two spaced intervals and extending from the ground surface downwardly within the subterranean well such that a first of said two spaced intervals communicates with a producing zone and a second of said two spaced intervals communicates with an injection zone;

a pump assembly, disposed in said casing, having an upper plunger, a middle plunger, and a lower plunger, said upper plunger coupled to said middle plunger and said middle plunger coupled to said lower plunger, said pump assembly reciprocable through an upstroke and a downstroke;

a first valve disposed on said upper plunger and a second valve disposed on said middle plunger, said first valve and said second valve responsive to the upstroke and the downstroke of said pump assembly;

a packer disposed within said casing between said first of said two spaced intervals and said second of said two spaced intervals, wherein said casing and said packer are configured to permit the produced fluid to collect above said packer whereby the produced hydrocarbons and produced water segregate by gravity;

an inlet disposed between said lower plunger and said packer, said inlet responsive to said upstroke of said pump assembly to permit unidirectional flow of the produced water segregated by gravity into said pump assembly below said lower plunger to form a column of produced water;

an outlet in fluid flow communication with said inlet and said pump assembly, said outlet responsive to said downstroke of said pump assembly to permit unidirectional flow of said column of produced water into said casing below said packer; and wherein said upper plunger has a surface area larger than a surface area of said lower plunger, thereby allowing said column of produced water to be injected into said casing at a magnified injection pressure.

2. An apparatus according to claim 1, further comprising:

a port disposed between said middle plunger and said lower plunger and in fluid flow communication with the produced hydrocarbons and portion of produced water segregated by gravity.

3. An apparatus according to claim 1, further comprising:

a pump drive located at the ground surface and coupled to said upper plunger to reciprocate said pump assembly through the upstroke and the downstroke.

4. An apparatus according to claim 1, further comprising:

a tubing extending from the ground surface downwardly within said casing.

5. An apparatus according to claim 4, wherein said pump assembly is disposed within said tubing.

6. An apparatus according to claim 5, wherein a portion of the produced fluid is disposed in said tubing above said upper plunger.

7. An apparatus according to claim 5, wherein said upper plunger, said middle plunger, and said lower plunger are sealingly disposed in said tubing.

8. An apparatus according to claim 1, further comprising:

a lower valve assembly having an upper and a lower portion, wherein said inlet is disposed in said upper portion and said outlet is disposed in said lower portion.

9. An apparatus according to claim 8, wherein said inlet and said outlet are ball valves.

10. An apparatus according to claim 1, further comprising:

a first connecting rod, said upper plunger being coupled to said middle plunger by said first connecting rod; and a second connecting rod, said middle plunger being coupled to said lower plunger by said second connecting rod.

11. An apparatus according to claim 1, wherein said middle plunger has a surface area larger than a surface area of said upper plunger and larger than a surface area of said lower plunger.

12. An apparatus for selectively lifting produced fluid, including produced hydrocarbons and a portion of produced water, to a ground surface and multiplying a hydrostatic head of a column of the produced fluid into a magnified injection pressure for injecting, without lifting to the ground surface, the remaining produced water, subsurface, in a subterranean well comprising:

a casing having two spaced intervals and extending from the ground surface downwardly within the subterranean well such that a first of said two spaced intervals communicates with a producing zone and a second of said two spaced intervals communicates with an injection zone;

a pump assembly, disposed in said casing, having an upper plunger, a middle plunger, and a lower plunger, said upper plunger coupled to said middle plunger and said middle plunger coupled to said lower plunger, said upper plunger having a surface area larger than a surface area of said lower plunger, and said pump assembly reciprocable through an upstroke and a downstroke;

a first valve disposed on said upper plunger and a second valve disposed on said middle plunger, said first valve and said second valve responsive to the upstroke and the downstroke of said pump assembly;

a packer disposed within said casing between said first of said two spaced intervals and said second of said two spaced intervals, wherein said casing and said packer are configured to permit the produced fluid to collect above said packer whereby the produced hydrocarbons and produced water segregate by gravity;

a port disposed between said middle plunger and said lower plunger and in fluid flow communication with the produced hydrocarbons and portion of produced water segregated by gravity;

an inlet disposed between said lower plunger and said packer, said inlet responsive to said upstroke of said pump assembly to permit unidirectional flow of the produced water segregated by gravity into said pump assembly below said lower plunger to form a column of produced water; and an outlet in fluid flow communication with said inlet and said pump assembly, said outlet responsive to said downstroke of said pump assembly to permit unidirectional flow of said column of produced water at the magnified injection pressure into said casing below said packer.

13. An apparatus according to claim 12, further comprising:

a lower valve assembly having an upper and a lower portion, wherein said inlet is disposed in said upper portion and said outlet is disposed in said lower portion.

14. An apparatus according to claim 13, wherein said lower inlet and said outlet are ball valves.

15. An apparatus according to claim 12, further comprising:

a first connecting rod, said upper plunger being coupled to said middle plunger by said first connecting rod; and a second connecting rod, said middle plunger being coupled to said lower plunger by said second connecting rod.

16. An apparatus according to claim 12, wherein said middle plunger has a surface area larger than said surface area of said upper plunger and larger than said surface area of said lower plunger.

17. An apparatus for selectively lifting produced fluid, including produced hydrocarbons and a portion of produced water, to a ground surface and injecting, without lifting to the ground surface, the remaining produced water, subsurface, in a subterranean well comprising:

a casing having two spaced intervals and extending from the ground surface downwardly within the subterranean well such that a first of said two spaced intervals communicates with a producing zone and a second of said two spaced intervals communicates with an injection zone;

a pump assembly, disposed in said casing, having an upper plunger, a middle plunger, and a lower plunger, said upper plunger coupled to said middle plunger and said middle plunger coupled to said lower plunger, said middle plunger having a surface area larger than a surface area of said upper plunger and larger than a surface area of said lower plunger, said pump assembly reciprocable through an upstroke and a downstroke;

a first valve disposed on said upper plunger and a second valve disposed on said middle plunger, said first valve and said second valve responsive to the upstroke and the downstroke of said pump assembly;

a packer disposed within said casing between said first of said two spaced intervals and said second of said two spaced intervals, wherein said casing and said packer are configured to permit the produced fluid to collect above said packer whereby the produced hydrocarbons and produced water segregate by gravity;

an inlet disposed between said lower plunger and said packer, said inlet responsive to said upstroke of said pump assembly to permit unidirectional flow of the produced water segregated by gravity into said pump assembly below said lower plunger to form a column of produced water; and an outlet in fluid flow communication with said inlet and said pump assembly, said outlet responsive to said downstroke of said pump assembly to permit unidirectional flow of said column of produced water into said casing below said packer.

* * * * *